US008366033B2

(12) United States Patent
Chang

(10) Patent No.: US 8,366,033 B2
(45) Date of Patent: Feb. 5, 2013

(54) CORD WINDING DEVICE FOR WINDOW COVERING

(75) Inventor: Chih-Kuang Chang, Hemei Township, Changhua County (TW)

(73) Assignee: Der Jaan Industry Co., Ltd., Changhua County (TW)

( * ) Notice: Subject to any disclaimer, the term of this patent is extended or adjusted under 35 U.S.C. 154(b) by 449 days.

(21) Appl. No.: 12/779,292

(22) Filed: May 13, 2010

(65) Prior Publication Data

US 2011/0278387 A1 Nov. 17, 2011

(51) Int. Cl.
*B65H 75/48* (2006.01)

(52) U.S. Cl. ... 242/376; 242/379; 242/407; 160/178.1 R

(58) Field of Classification Search ..... 242/370, 242/371, 376, 379, 398, 407, 385.1, 375; 160/168.1 R, 173 R, 178.1 R
See application file for complete search history.

(56) References Cited

U.S. PATENT DOCUMENTS 6,463,986 B1 * 10/2002 Gouda ..... 160/178.1 R
6,745,969 B1 * 6/2004 Gouda ..... 242/375

* cited by examiner

*Primary Examiner* — Michael Mansen
*Assistant Examiner* — Juan Campos, Jr.
(74) *Attorney, Agent, or Firm* — Alan Kamrath; Kamrath IP Lawfirm, P.A.

(57) ABSTRACT

A cord winding device for a window covering includes a casing, a reel rotatably mounted on the casing, a torsion spring biased between the casing and the reel, a limit ring secured on the casing and abutting the reel to limit the reel between the casing and the limit ring, and a pull cord attached a bottom of the casing. Thus, the lift cord of the window covering is wound around and stored in the reel of the cord winding device so that the lift cord is rolled up to a higher position to prevent the children from being tangled with the lift cord so as to protect the safety of the children.

7 Claims, 9 Drawing Sheets

CORD WINDING DEVICE FOR WINDOW COVERING

BACKGROUND OF THE INVENTION

1. Field of the Invention

The present invention relates to a winding device and, more particularly, to a cord winding device for a window covering, such as a Venetian blind, roman shade, roll-up blind and the like.

2. Description of the Related Art

A conventional window covering, such as a Venetian blind and the like, comprises a headrail, a bottom rail, a plurality of laths mounted between the headrail and the bottom rail, and a lift cord movably mounted on the headrail and connected with the laths to lift or lower the laths. However, the lift cord has an endless shape and is located at a lower position that can be reached by the children so that the children are easily tangled with the lift cord, thereby causing danger to the children. In addition, the lift cord is exposed outward and depend downward from the headrail, thereby greatly decreasing the aesthetic quality of the window covering.

BRIEF SUMMARY OF THE INVENTION

In accordance with the present invention, there is provided a cord winding device for a window covering, comprising a casing, a reel rotatably mounted on the casing, a torsion spring biased between the casing and the reel, a limit ring secured on the casing and abutting the reel to limit the reel between the casing and the limit ring, and a pull cord attached a bottom of the casing.

The casing has an open side formed with a receiving space to receive the reel. The receiving space of the casing has a bottom wall provided with a pivot shaft. The casing has a periphery provided with a reduced mounting shoulder for mounting the limit ring. The casing has a top formed with a first slot connected to the receiving space.

The limit ring is secured on the reduced mounting shoulder of the casing. The limit ring has a top formed with a second slot which is juxtaposed to the first slot of the casing and is connected to the receiving space. The limit ring has an inner portion formed with an exposing hole facing the reel to expose the reel.

The reel is rotatably mounted in the receiving space of the casing. The reel includes two stop disks and a spool located between the two stop disks to form a winding space between the two stop disks and the spool. The winding space of the reel is connected to the receiving space of the casing and is connected to first slot of the casing and the second slot of the limit ring. The spool of the reel has an open side formed with a receiving chamber to receive the pivot shaft of the casing and the torsion spring. The receiving chamber of the spool has a bottom wall provided with a pivot hole rotatably mounted on the pivot shaft of the casing so that the spool of the reel is rotatable on the pivot shaft of the casing. One of the two stop disks of the reel has a periphery formed with a recessed driving portion exposed outward from the exposing hole of the limit ring. The driving portion of the reel has a bottom wall formed with a hooking hole exposed outward from the exposing hole of the limit ring. The hooking hole of the driving portion is connected to the winding space of the reel and extends through the spool into the receiving chamber of the spool.

According to the primary advantage of the present invention, the lift cord of the window covering is wound around and stored in the reel of the cord winding device so that the lift cord is rolled up to a higher position to prevent the children from being tangled with the lift cord so as to protect the safety of the children.

According to another advantage of the present invention, the lift cord is almost rolled by and stored in the reel so that the lift cord will not be exposed outward from the window covering so as to enhance the aesthetic quality of the window covering.

According to a further advantage of the present invention, the user only needs to pull the pull cord so as to expose the lift cord for use with the user so that the cord winding device can be operated easily and quickly.

According to a further advantage of the present invention, the pull cord is located at a higher position that is reached by the adult only and will not be reached by the children so as to protect the safety of the children.

According to a further advantage of the present invention, the pull cord is a single strip that does not have an endless shape so that the pull cord will not be tangled with the children to prevent from causing danger to the children.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
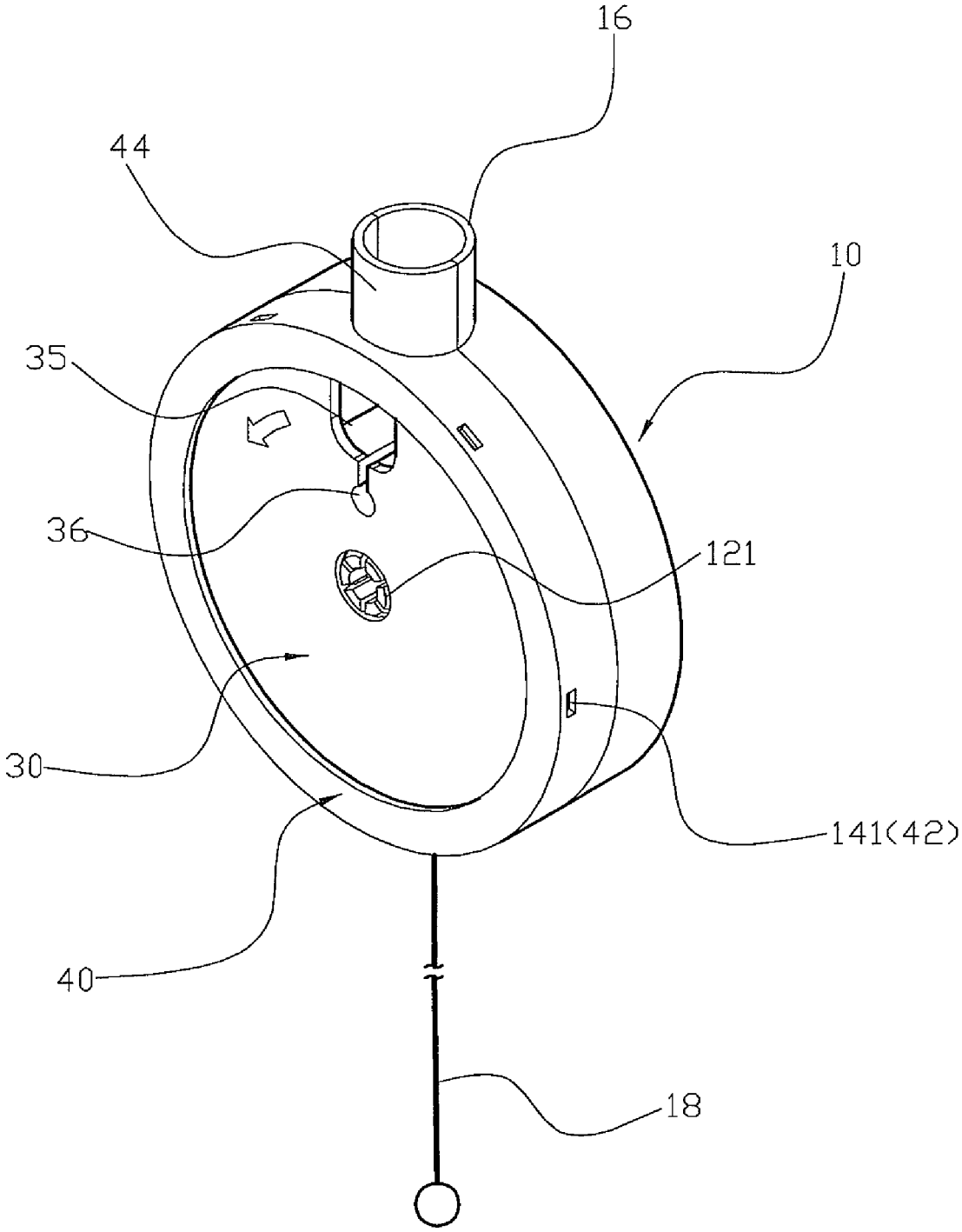
FIG. 1 is a perspective view of a cord winding device for a window covering in accordance with the preferred embodiment of the present invention.

Referring to the drawings and initially to FIGS. 1-4, a cord winding device for a window covering in accordance with the preferred embodiment of the present invention comprises a casing 10, a reel 30 rotatably mounted on the casing 10, a torsion spring 20 biased between the casing 10 and the reel 30, a limit ring 40 secured on the casing 10 and abutting the reel 30 to limit the reel 30 between the casing 10 and the limit ring 40, and a pull cord 18 attached a bottom of the casing 10.

The casing 10 has a cylindrical shape and has an open side formed with a receiving space 11 to receive the reel 30. The receiving space 11 of the casing 10 has a bottom wall provided with a pivot shaft 12. The pivot shaft 12 of the casing 10 is located at a central portion of the casing 10. The casing 10 has a periphery provided with a reduced mounting shoulder 14 for mounting the limit ring 40. The casing 10 has a top formed with a first slot 15 connected to the receiving space 11. The bottom wall of the receiving space 11 of the casing 10 has a surface provided with a first positioning stub 13 to locate the torsion spring 20 and provided with an annular support flange 19. The pivot shaft 12 of the casing 10 has a distal end provided with a flexible locking head 121. The locking head 121 of the pivot shaft 12 has a hook shape and is formed by a plurality of elastic wedges and a plurality of slits disposed between the elastic wedges. The reduced mounting shoulder 14 of the casing 10 has a periphery provided with a plurality of elastic locking hooks 141. The top of the casing 10 has a surface provided with a first semi-tube 16 surrounding the first slot 15. The bottom of the casing 10 has a surface provided with a hanging hook 17 secured on an upper end of the pull cord 18.

The limit ring 40 is secured on the reduced mounting shoulder 14 of the casing 10. The limit ring 40 has a top formed with a second slot 43 which is juxtaposed to the first slot 15 of the casing 10 and is connected to the receiving space 11 of the casing 10. The limit ring 40 has an inner portion formed with an exposing hole 41 facing the reel 30 to expose the reel 30. The limit ring 40 has a periphery provided with a plurality of locking holes 42 snapped onto the locking hooks 141 of the reduced mounting shoulder 14 to lock the limit ring 40 onto the casing 10. The top of the limit ring 40 has a surface provided with a second semi-tube 44 surrounding the second slot 43. The second semi-tube 44 of the limit ring 40 is juxtaposed to the first semi-tube 16 of the casing 10 to form a tube surrounding the first slot 15 of the casing 10 and the second slot 43 of the limit ring 40.

The reel 30 is rotatably mounted in the receiving space 11 of the casing 10. The reel 30 includes two stop disks 31 and a spool 32 located between the two stop disks 31 to form a winding space 33 between the two stop disks 31 and the spool 32. The winding space 33 of the reel 30 is connected to the receiving space 11 of the casing 10 and is connected to first slot 15 of the casing 10 and the second slot 43 of the limit ring 40. The spool 32 of the reel 30 has an open side formed with a receiving chamber 34 to receive the pivot shaft 12 of the casing 10 and the torsion spring 20. The receiving chamber 34 of the spool 32 has a bottom wall provided with a pivot hole 342 rotatably mounted on the pivot shaft 12 of the casing 10 so that the spool 32 of the reel 30 is rotatable on the pivot shaft 12 of the casing 10. One of the two stop disks 31 of the reel 30 has a periphery formed with a recessed driving portion 35 exposed outward from the exposing hole 41 of the limit ring 40. The driving portion 35 of the reel 30 has a bottom wall formed with a hooking hole 36 exposed outward from the exposing hole 41 of the limit ring 40. The hooking hole 36 of the driving portion 35 is connected to the winding space 33 of the reel 30 and extends through the spool 32 into the receiving chamber 34 of the spool 32. The bottom wall of the receiving chamber 34 of the spool 32 has a surface provided with a second positioning stub 341 to locate the torsion spring 20. The pivot hole 342 of the spool 32 is located at a central portion of the spool 32 and has a peripheral wall locked onto the locking head 121 of the pivot shaft 12 to attach the spool 32 of the reel 30 to the pivot shaft 12 of the casing 10. The receiving chamber 34 of the spool 32 is rotatably mounted on and supported by the support flange 19 of the casing 10.

The torsion spring 20 is mounted on the pivot shaft 12 of the casing 10 and has a first end secured on the first positioning stub 13 of the casing 10 and a second end secured on the second positioning stub 341 of the reel 30.

Figure 2:
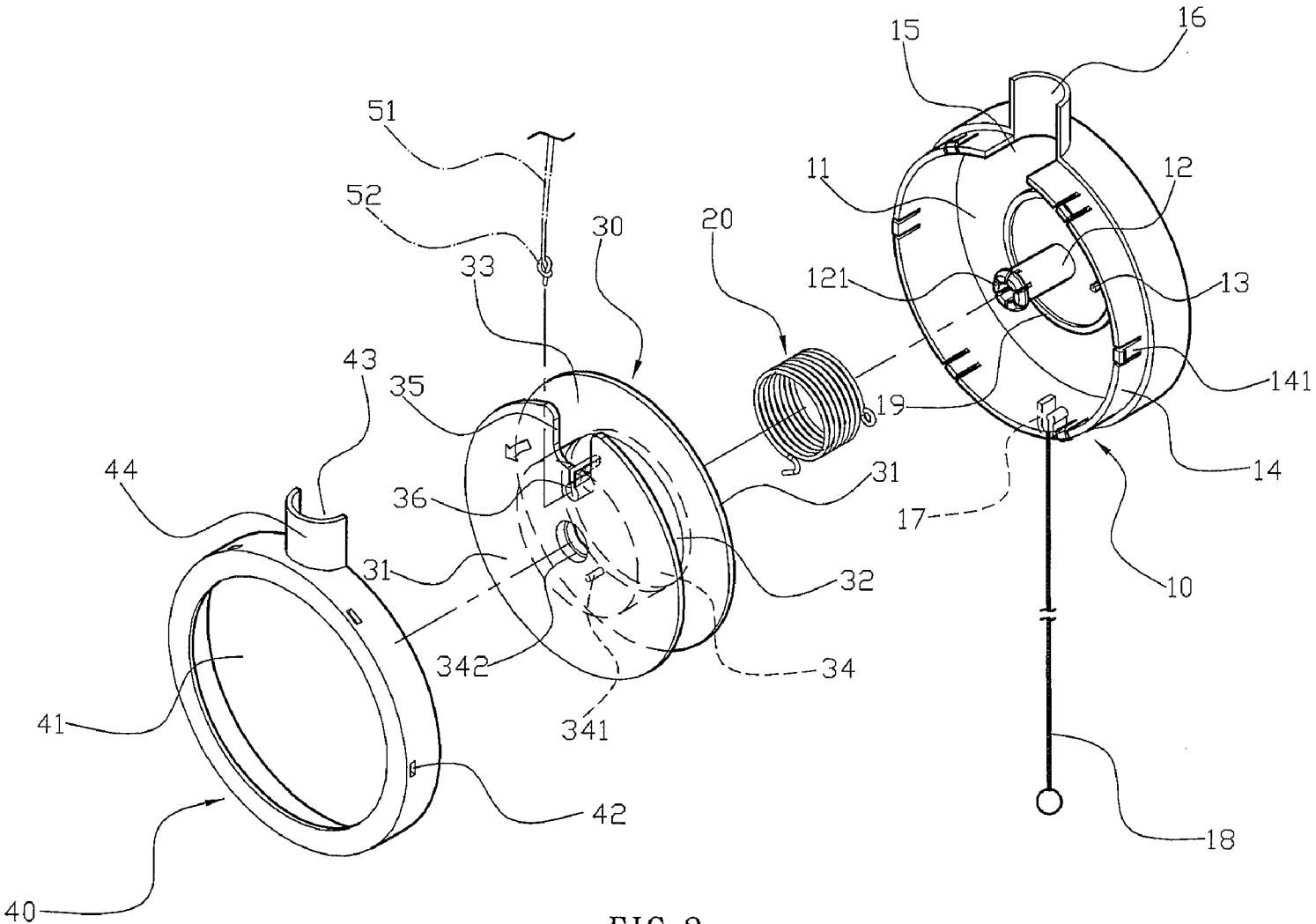
FIG. 2 is an exploded perspective view of the cord winding device for a window covering as shown in FIG. 1.
Figure 3:
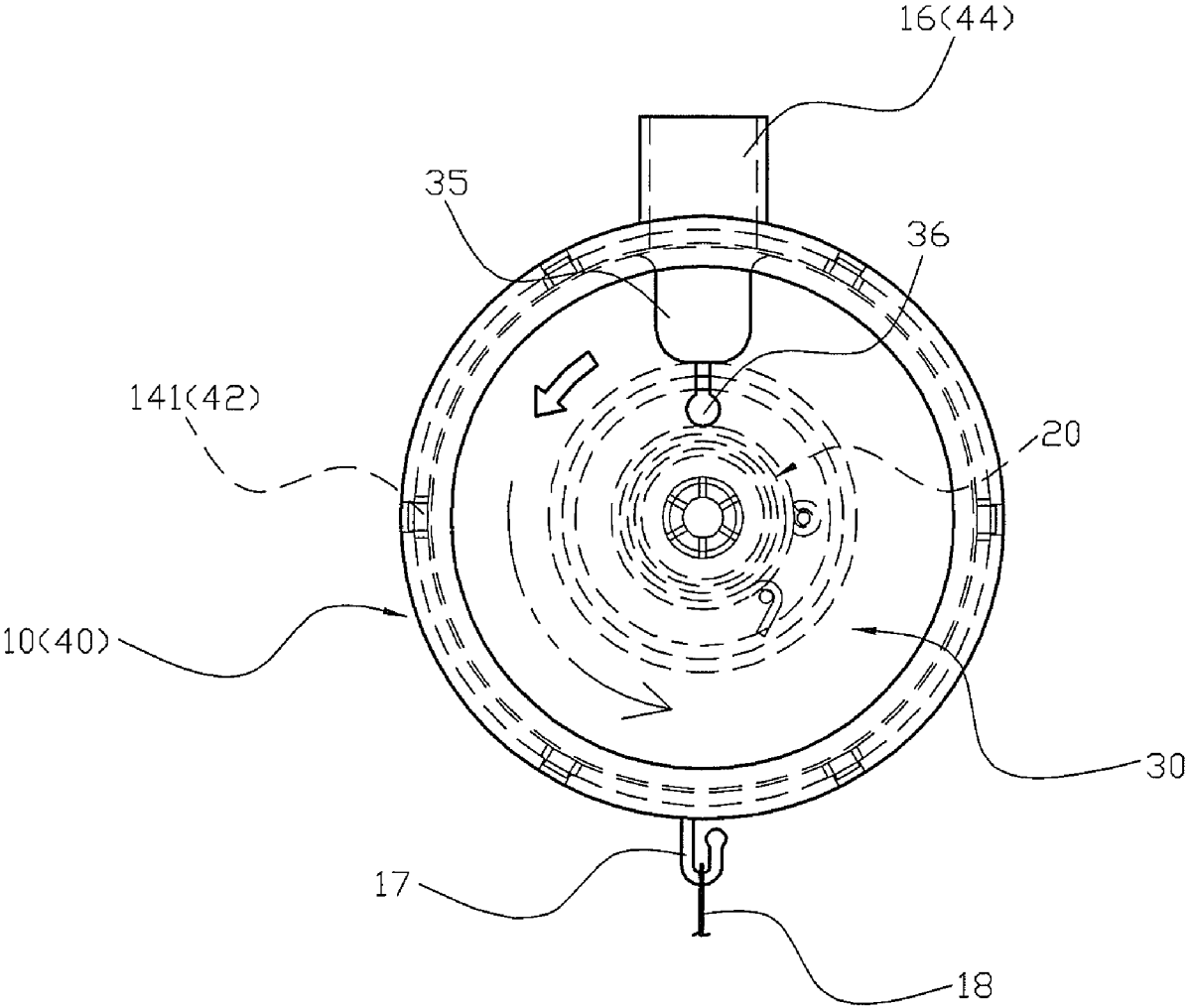
FIG. 3 is a front view of the cord winding device for a window covering as shown in FIG. 1.
Figure 4:
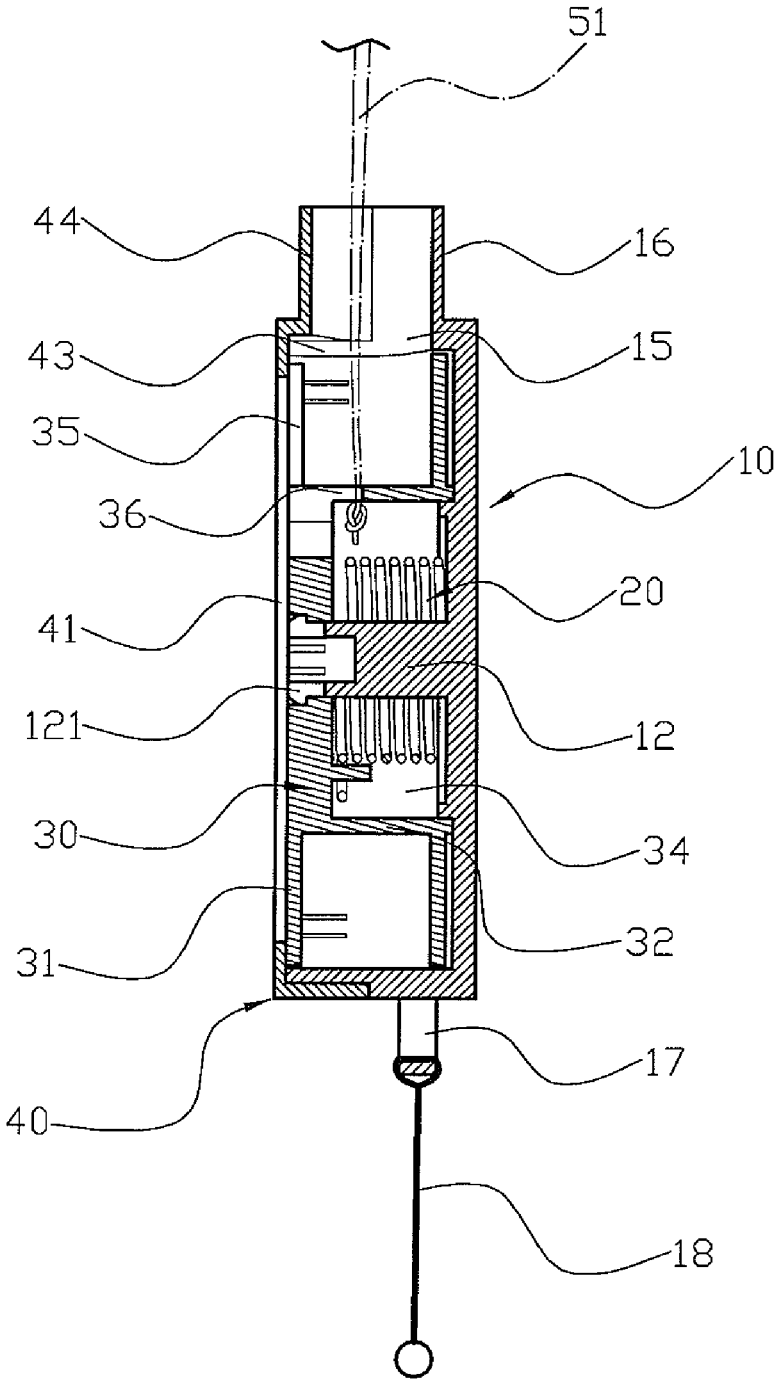
FIG. 4 is a side cross-sectional view of the cord winding device for a window covering as shown in FIG. 1.
Figure 5:
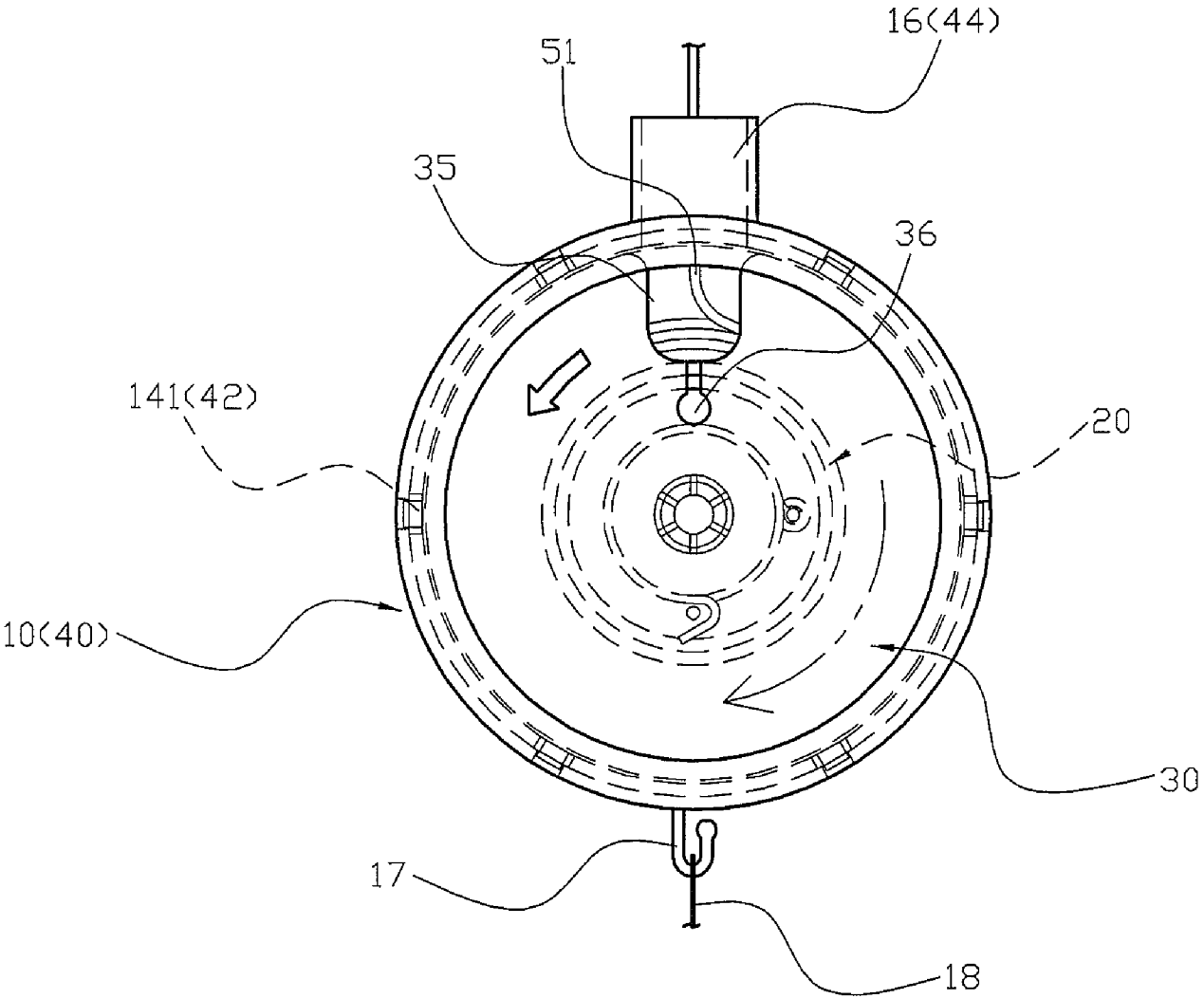
FIG. 5 is a schematic operational view of the cord winding device for a window covering as shown in FIG. 3.
Figure 6:
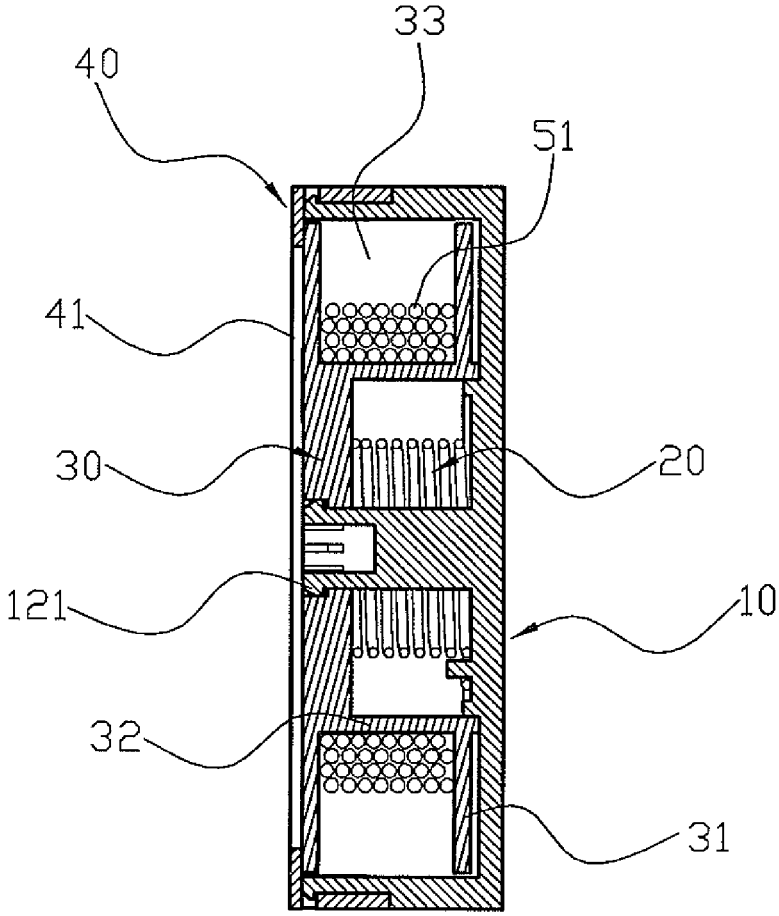
FIG. 6 is a schematic operational view of the cord winding device for a window covering as shown in FIG. 4.

In operation, referring to FIGS. 3-6 with reference to FIGS. 1 and 2, the driving portion 35 of the reel 30 is exposed outward from the exposing hole 41 of the limit ring 40 as shown in FIG. 1 to allow insertion of a user's one finger. In such a manner, the driving portion 35 of the reel 30 can be driven by a rotation force applied by the user to rotate the reel 30 relative to the casing 10 so as to twist and distort the torsion spring 20 as shown in FIG. 3 so that the torsion spring 20 stores a restoring force. Then, a lift cord 51 of a window covering 50 (see FIG. 7) is inserted through the first semi-tube 16 of the casing 10 and the second semi-tube 44 of the limit ring 40, the first slot 15 of the casing 10 and the second slot 43 of the limit ring 40 into the winding space 33 of the reel 30. Then, a knot 52 of the lift cord 51 is snapped into and locked in the hooking hole 36 of the driving portion 35 as shown in FIG. 4 to attach the reel 30 to the lift cord 51 of the window covering 50. After the rotation force applied on the reel 30 is removed, the reel 30 is driven by the restoring force of the torsion spring 20 and is rotated relative to the casing 10 in the opposite direction as shown in FIG. 5 to wind the lift cord 51 of the window covering 50 around the spool 32 of the reel 30 so that the lift cord 51 of the window covering 50 is wound around the spool 32 of the reel 30 successively and is stored in the winding space 33 of the reel 30 as shown in FIG. 6.

Figure 7:
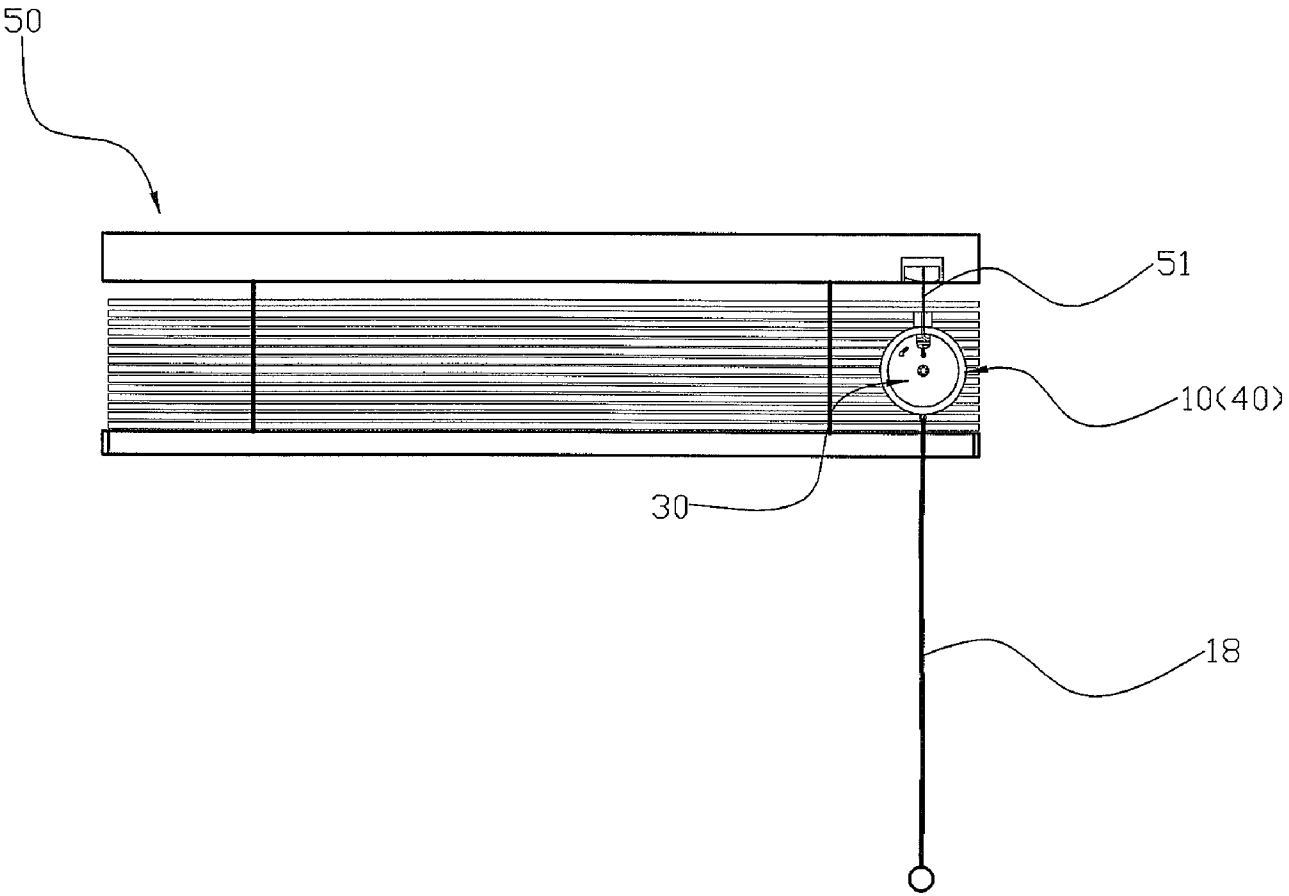
FIG. 7 is a front operational view of the cord winding device for a window covering as shown in FIG. 1.

As shown in FIG. 7, the reel 30 is rolled up to wind the lift cord 51 of the window covering 50 so that the lift cord 51 of the window covering 50 is almost rolled by and stored in the reel 30 of the cord winding device and will not be exposed outward from the window covering 50 to enhance the aesthetic quality of the window covering 50. At this time, the lift cord 51 of the window covering 50 is rolled up to a higher position, while the pull cord 18 depends from the casing 10 and is located at a greater height that is reached by the adult only and will not be reached by the children to protect the safety of the children. In addition, the pull cord 18 is a single strip that does not have an endless shape so that the pull cord 18 will not be tangled with the children to prevent from causing danger to the children.

Figure 8:
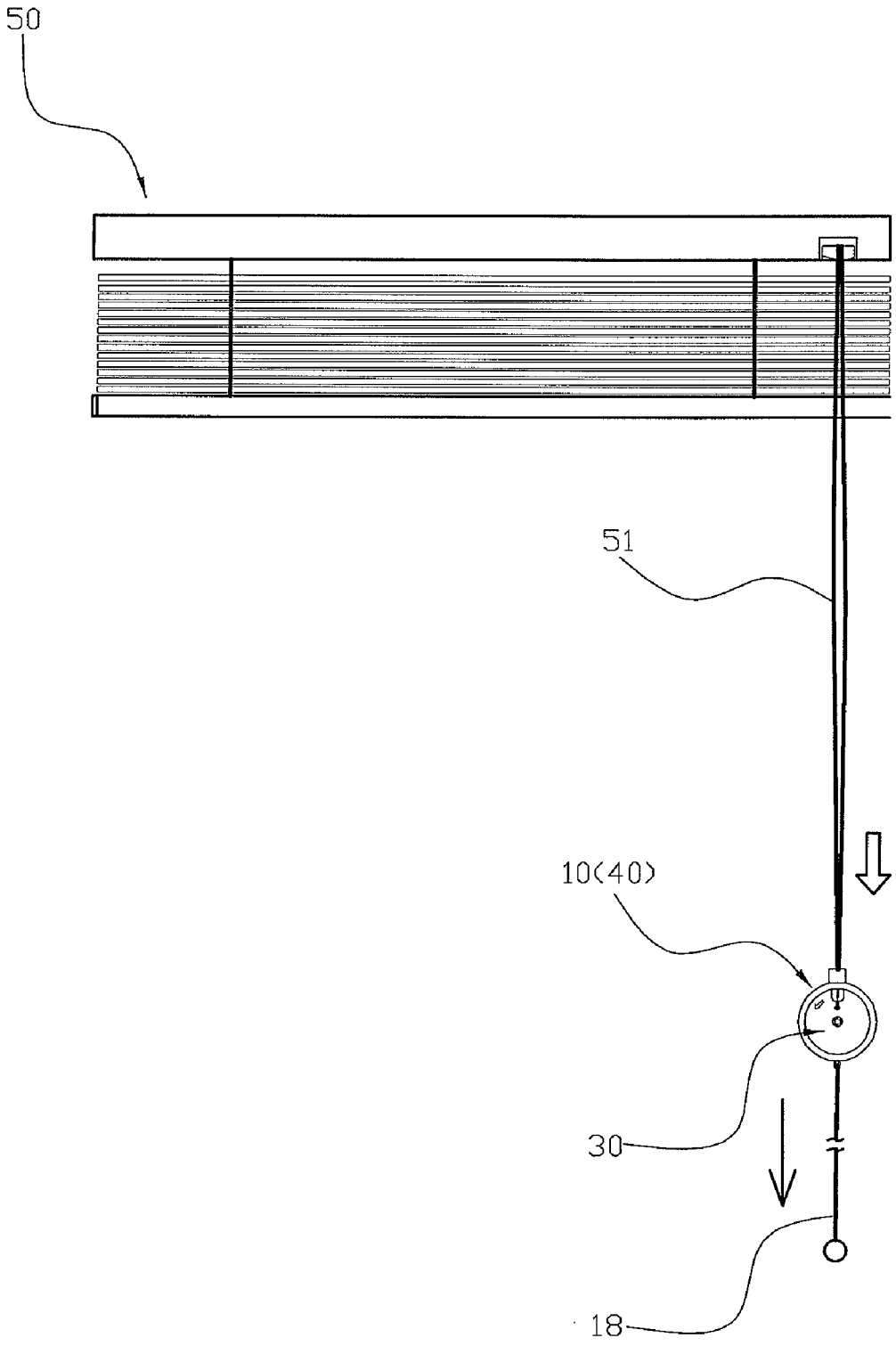
FIG. 8 is a schematic operational view of the cord winding device for a window covering as shown in FIG. 7.

As shown in FIG. 8, the pull cord 18 is pulled downward, the lift cord 51 of the window covering 50 is unwound from the reel 30 and is exposed outward for use with a user. At this time, the reel 30 is rotated relative to the casing 10 so as to twist and distort the torsion spring 20 so that the torsion spring 20 stores its restoring force again.

Figure 9:
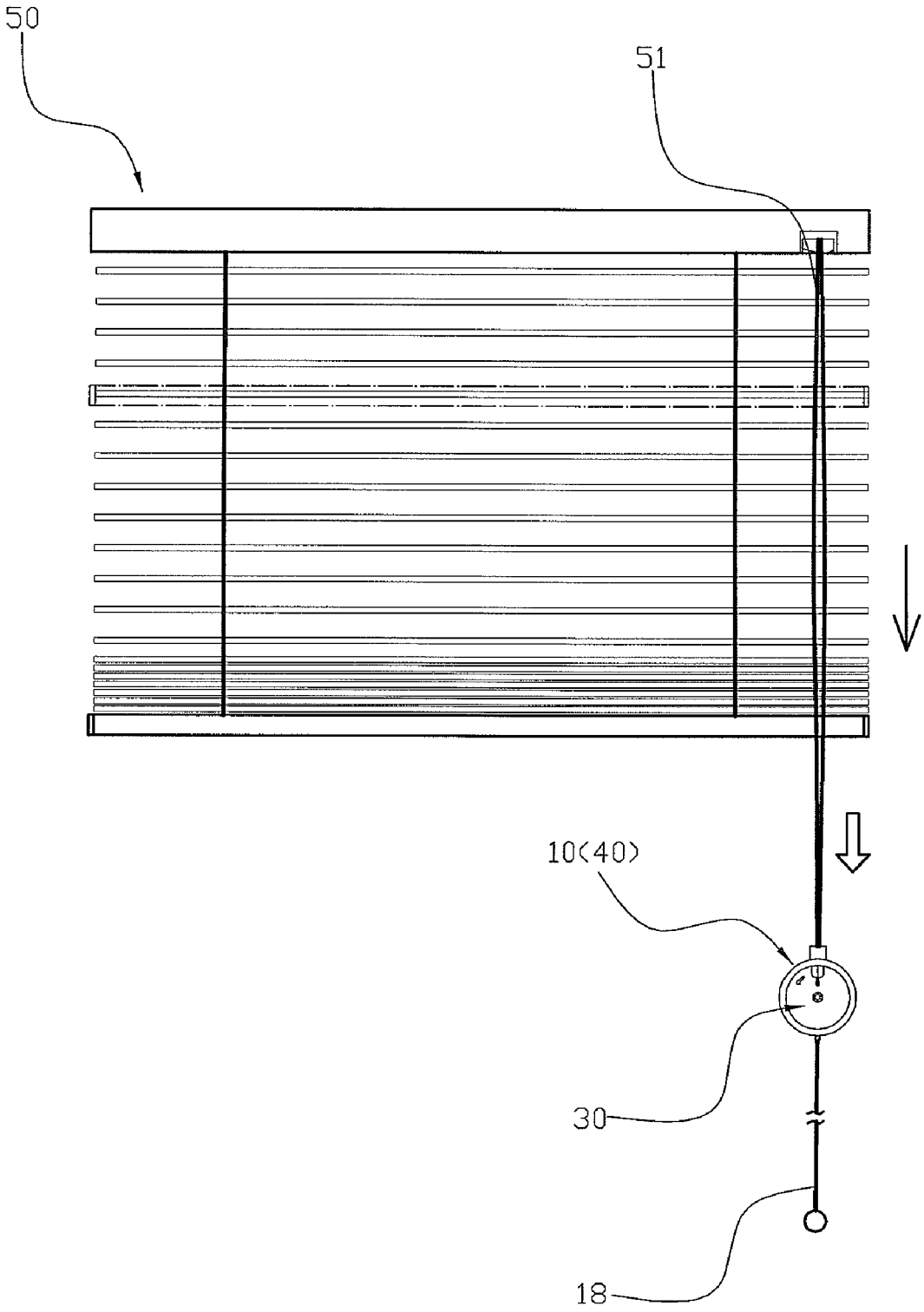
FIG. 9 is a schematic operational view of the cord winding device for a window covering as shown in FIG. 8.

As shown in FIG. 9, the lift cord 51 of the window covering 50 is operated to lift or lower the shades of the window covering 50.

Accordingly, the lift cord 51 of the window covering 50 is wound around and stored in the reel 30 of the cord winding device so that the lift cord 51 is rolled up to a higher position to prevent the children from being tangled with the lift cord 51 so as to protect the safety of the children. In addition, the lift cord 51 is almost rolled by and stored in the reel 30 so that the lift cord 51 will not be exposed outward from the window covering 50 so as to enhance the aesthetic quality of the window covering 50. Further, the user only needs to pull the pull cord 18 so as to expose the lift cord 51 for use with the user so that the cord winding device can be operated easily and quickly. Further, the pull cord 18 is located at a higher position that is reached by the adult only and will not be reached by the children so as to protect the safety of the children. Further, the pull cord 18 is a single strip that does not have an endless shape so that the pull cord 18 will not be tangled with the children to prevent from causing danger to the children.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A cord winding device for a window covering, comprising:

a casing;

a reel rotatably mounted on the casing;

a torsion spring biased between the casing and the reel;

a limit ring secured on the casing and abutting the reel to limit the reel between the casing and the limit ring; and a pull cord attached a bottom of the casing;

wherein the casing has an open side formed with a receiving space to receive the reel;

the receiving space of the casing has a bottom wall provided with a pivot shaft;

the casing has a periphery provided with a reduced mounting shoulder for mounting the limit ring;

the casing has a top formed with a first slot connected to the receiving space;

the limit ring is secured on the reduced mounting shoulder of the casing;

the limit ring has a top formed with a second slot which is juxtaposed to the first slot of the casing and is connected to the receiving space;

the limit ring has an inner portion formed with an exposing hole facing the reel to expose the reel;

the reel is rotatably mounted in the receiving space of the casing;

the reel includes two stop disks and a spool located between the two stop disks to form a winding space between the two stop disks and the spool;

the winding space of the reel is connected to the receiving space of the casing;

the winding space of the reel is connected to first slot of the casing and the second slot of the limit ring;

the spool of the reel has an open side formed with a receiving chamber to receive the pivot shaft of the casing and the torsion spring;

the receiving chamber of the spool has a bottom wall provided with a pivot hole rotatably mounted on the pivot shaft of the casing so that the spool of the reel is rotatable on the pivot shaft of the casing;

one of the two stop disks of the reel has a periphery formed with a recessed driving portion exposed outward from the exposing hole of the limit ring;

the driving portion of the reel has a bottom wall formed with a hooking hole exposed outward from the exposing hole of the limit ring;

the hooking hole of the driving portion is connected to the winding space of the reel and extends through the spool into the receiving chamber of the spool.

2. The cord winding device for a window covering of claim 1, wherein the bottom wall of the receiving space of the casing has a surface provided with a first positioning stub to locate the torsion spring;

the bottom wall of the receiving chamber of the spool has a surface provided with a second positioning stub to locate the torsion spring;

the torsion spring is mounted on the pivot shaft of the casing and has a first end secured on the first positioning stub of the casing and a second end secured on the second positioning stub of the reel.

3. The cord winding device for a window covering of claim 1, wherein the pivot shaft of the casing is located at a central portion of the casing;

the pivot shaft of the casing has a distal end provided with a flexible locking head;

the locking head of the pivot shaft has a hook shape and is formed by a plurality of elastic wedges and a plurality of slits disposed between the elastic wedges;

the pivot hole of the spool is located at a central portion of the spool and has a peripheral wall locked onto the locking head of the pivot shaft to attach the spool of the reel to the pivot shaft of the casing.

4. The cord winding device for a window covering of claim 1, wherein the reduced mounting shoulder of the casing has a periphery provided with a plurality of elastic locking hooks;

the limit ring has a periphery provided with a plurality of locking holes snapped onto the locking hooks of the reduced mounting shoulder to lock the limit ring onto the casing.

5. The cord winding device for a window covering of claim 1, wherein the top of the casing has a surface provided with a first semi-tube surrounding the first slot;

the top of the limit ring has a surface provided with a second semi-tube surrounding the second slot;

the second semi-tube of the limit ring is juxtaposed to the first semi-tube of the casing to form a tube surrounding the first slot of the casing and the second slot of the limit ring.

6. The cord winding device for a window covering of claim 1, wherein the bottom of the casing has a surface provided with a hanging hook secured on an upper end of the pull cord.

7. The cord winding device for a window covering of claim 1, wherein the bottom wall of the receiving space of the casing has a surface provided with provided with an annular support flange;

the receiving chamber of the spool is rotatably mounted on and supported by the support flange of the casing.

* * * * *